US011136891B2

(12) United States Patent
Gossilin et al.

(10) Patent No.: US 11,136,891 B2
(45) Date of Patent: Oct. 5, 2021

(54) WALL COMPRISING A FILM COOLING HOLE

(71) Applicant: Siemens Aktiengesellschaft, Munich (DE)

(72) Inventors: Ralph Gossilin, Oberhausen (DE); Andreas Heselhaus, Düsseldorf (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 127 days.

(21) Appl. No.: 16/479,568

(22) PCT Filed: Jan. 30, 2018

(86) PCT No.: PCT/EP2018/052253
§ 371 (c)(1),
(2) Date: Jul. 19, 2019

(87) PCT Pub. No.: WO2018/141739
PCT Pub. Date: Aug. 9, 2018

(65) Prior Publication Data

US 2019/0345828 A1 Nov. 14, 2019

(30) Foreign Application Priority Data

Jan. 31, 2017 (EP) ..... 17153959

(51) Int. Cl.
*F01D 5/18* (2006.01)
*F23R 3/06* (2006.01)

(52) U.S. Cl.
CPC ..... *F01D 5/186* (2013.01); *F23R 3/06* (2013.01); *F05D 2240/127* (2013.01);
(Continued)

(58) Field of Classification Search
CPC .. F01D 5/186; F23R 2900/03042; F23R 3/06; F05D 2240/127; F05D 2250/11; F05D 2260/202; F05D 2250/23; F05D 2250/21
See application file for complete search history.

(56) References Cited

U.S. PATENT DOCUMENTS 5,609,779 A * 3/1997 Crow ..... B23K 26/0622 219/121.71
5,829,967 A 11/1998 Chyou
(Continued)

FOREIGN PATENT DOCUMENTS

EP 1882818 A1 * 1/2008 ..... B22C 9/04
EP 1967696 A1 9/2008
(Continued)

OTHER PUBLICATIONS

PCT International Search Report and Written Opinion of International Searching Authority dated Apr. 23, 2018 corresponding to PCT International Application No. PCT/EP2018/052253 filed Jan. 30, 2018.

*Primary Examiner* — J. Todd Newton, Esq.

(57) ABSTRACT

A wall of a hot gas part, having a first surface subjectable to a cooling fluid, a second surface located opposite of the first surface and subjectable to a hot gas and, at least one film cooling hole extending from an inlet area located within the first surface to an outlet area located within the second surface for leading the cooling fluid from the first surface to the second surface. The respective film cooling hole has a diffusor section located upstream of the outlet area, the diffusor section is bordered at least by a diffusor bottom and two opposing diffusor side walls, wherein the diffusor section has a delta wedge element for dividing the cooling fluid flow into two sub-flows and subsequent formation of a pair of delta vortices. The respective delta wedge element pro-
(Continued)

trudes in a step-wise manner from the diffusor bottom and is, in a top view, triangular-shaped.

9 Claims, 5 Drawing Sheets

(52) U.S. Cl.
CPC .... *F05D 2250/11* (2013.01); *F05D 2260/202* (2013.01); *F23R 2900/03042* (2013.01)

(56) References Cited

U.S. PATENT DOCUMENTS

2005/0135931 A1* 6/2005 Nakamata ..... F01D 5/186 416/97 R
2010/0040459 A1* 2/2010 Ohkita ..... F01D 5/186 415/177
2010/0068068 A1* 3/2010 Liang ..... F01D 5/186 416/97 R
2010/0282721 A1* 11/2010 Bunker ..... B23K 26/389 219/121.61
2011/0293423 A1* 12/2011 Bunker ..... F01D 5/186 416/95
2011/0305583 A1 12/2011 Lee
2012/0076653 A1 3/2012 Beeck et al.
2013/0205794 A1 8/2013 Xu
2013/0205801 A1* 8/2013 Xu ..... F01D 5/186 60/806
2013/0205802 A1 8/2013 Levasseur et al.
2013/0209233 A1* 8/2013 Xu ..... F01D 5/186 415/116
2016/0273364 A1 9/2016 Bergholz
2019/0345828 A1* 11/2019 Gossilin ..... F01D 5/186

FOREIGN PATENT DOCUMENTS

EP 2876258 A1 5/2015
GB 2409243 A 6/2005
JP H08270948 A 10/1996
JP H1089005 A 4/1998
JP 2008248733 A 10/2008
JP 2009041433 A 2/2009
JP 2013083272 A 5/2013

* cited by examiner

WALL COMPRISING A FILM COOLING HOLE

CROSS REFERENCE TO RELATED APPLICATIONS

This application is the US National Stage of International Application No. PCT/EP2018/052253 filed Jan. 30, 2018, and claims the benefit thereof. The International Application claims the benefit of European Application No. EP17153959 filed Jan. 31, 2017. All of the applications are incorporated by reference herein in their entirety.

FIELD OF INVENTION

The invention relates to a wall of a hot gas part, for example of a gas turbine, comprising at least one film cooling hole with a diffusor section.

BACKGROUND OF INVENTION

Hot gas parts like turbine blades and turbine vanes of a gas turbine and also their film cooling holes are well known in the prior art. When film cooling holes are used for applying film cooling to thermally loaded parts the desire is generally to isolate the wall surface from the hot gas by a layer of cooling air. Cooling air jets ejecting from the film cooling holes create vortices which influence the insolating layer of cooling air. However, said vortices disturb the film cooling layer and reduce the film cooling effectiveness.

Two vortex types mainly contribute to this disturbance: A first counter rotating pair of vortices being initiated at the cooling hole inlet—also known as "kidney vortex"- and a second pair of vortices created by the drag of hot gas being directed around and beneath the jet emerging from the film cooling hole outlet—also known as "chimney vortex". These two pairs of vortices rotate in the same way and add to each other in strength. Due to their sense of rotation they drag hot gas from outside the isolating film between two neighbored film streaks down to the surface, from which the hot gas originally should be kept separated. This effect partially destroys the film cooling effectiveness and more cooling air has to be spent to achieve the desired film cooling effect, which is negatively influencing the efficiency of the gas turbine.

Up to now, researchers try to shape the diffusors and the outlet areas of the film cooling holes at the exit of cylindrical film cooling holes in a way that they reduce the momentum of the exiting cooling air jet as much as possible and to widen the footprint of cooled surface that the jet leaves on the wall surface. In this context both patent publications JP 2013-83272 A and JP H10-89005 A disclose different designs of a split element located in a diffusor of film cooling holes. Each of the designs shall increase the spreading of the cooling air flow in lateral direction. For the same target EP 1 967 696 A1 proposes a modified opening geometry of the film cooling hole diffusor. The film cooling hole is shaped that the outlet surface of the diffusor portion from a center portion to both end sides leans toward the downstream side of the hot gas and the bottom surface of the diffusor leans toward an upstream side of the hot gas at a center.

Further, GB 2 409 243 A discloses a film cooling hole comprising one joined metering section followed by two associated, but completely separated diffusor sections. This geometry enables a larger lateral opening angle while reducing the number of film cooling holes. However, the manufacturing of film cooling holes with two independent diffusor sections and a combined metering section is difficult and time consuming.

Other concepts to reduce the harmful vortices deal with optimizing the shape of the diffusor or criss-cross orientation of pairs of film holes so that the vortices counteract on each other.

In general, the remaining swirl is accepted and its harmful effect is compensated by an increased amount of film cooling air.

Further it is known from EP 2 990 605 A1 to modify the film cooling hole inlet, so that the sense of rotation of the kidney vortex is inversed. Thereby the air swirl at the border between two neighbored jets is directed away from the surface, while at the center (where the drag is towards the surface) the harmful effect is compensated by the cold core and the momentum of the jet itself.

This concept showed to be beneficial, however it turned out that wall friction inside the holes tends to damp the kidney vortex swirl of the cooling air on its way through the hole. By this, especially for long cooling holes the swirl of the inversed kidney vortices counter-acting on the chimney vortex is reduced and thereby also the benefit on film effectiveness.

SUMMARY OF INVENTION

Therefore it is an object of the invention to provide a film cooling hole with increased cooling film capabilities.

This object of the invention is achieved by the independent claim. The dependent claims describe advantageous developments and modifications of the invention. Their features could be combined arbitrarily.

In accordance with the invention there is provided a wall of a hot gas part, the wall comprising a first surface subjectable to a cooling fluid, a second surface located opposite of the first surface and subjectable to a hot gas and, at least one film cooling hole, in particular multiple film cooling holes, each extending from an inlet area located within the plane of the first surface to an outlet area located in the plane of the second surface for leading the cooling fluid from the first surface to the second surface, the at least one film cooling hole comprising further a diffusor section being located upstream of the outlet area with regard to a direction of the cooling fluid flow through the film cooling hole, the diffusor section being bordered at least by a diffusor bottom and two opposing diffusor side walls, wherein the diffusor section comprises a delta wedge element which during operation divides the cooling fluid flow into two subflows, wherein the delta wedge element extends from a leading edge to a trailing end with regard to direction of the cooling fluid flow, wherein the delta wedge element protrudes in a stepwise manner from the diffusor bottom and is, in a top view, triangular-shaped.

Hence the main idea of this invention is to provide a specific delta wedge element able to create a pair of vortices counter-acting on the chimney vortex downstream of the outlet area of the film cooling hole. This shall compensate the harmful effect of the chimney vortex on the film cooling effectiveness leading to improved film cooling capabilities.

The delta wedge element is triangular-shaped, comprising a leading edge and a trailing end. The leading edge of the delta wedge element, which is directed against the approaching cooling fluid flow, is a sharp edge. Preferably, the leading edge protrudes in a stepwise manner i.e. under formation of a step from a bottom of the diffusor section. Preferably, in a side view, the leading edge protrudes with an angle of 35° or larger, most advantageous with an angle of 90° from the diffusor bottom. These features enable and support the generation of delta-vortices.

The delta wedge element comprises one top surface and two side surfaces. The two side surfaces are arranged in v-style merging at the leading edge and diverging towards the trailing end. Each side surface and the top surface merge at longitudinal edges, which are arranged in v-style correspondingly. Then, during operation the delta wedge element acts as a "delta vortex generator" and generates a pair of vortices when the cooling fluid flows over the longitudinal edges. The delta wedge element is, when delta-shaped, symmetrically designed with two longitudinal edges having the same length between the leading edge and the trailing end. This embodiment is beneficial for diffusor sections with symmetrical side walls.

Beneficially, the two longitudinal edges, each extending from the leading edge to the trailing end, incorporate a wedge-angle β there between; the wedge-angle β is advantageously at least 15°. Delta wedge elements with such a wedge-angle should provide sufficient large delta-vortices. However, larger angles are even better for the intended purpose.

Preferably, the two opposing diffusor side walls in a top view incorporate a lateral opening angle, which is smaller than the wedge-angle. With this advantageous embodiment the cross section of each single passage between the delta wedge element and the respective diffusor side wall decreases in flow direction of cooling fluid. The decrement of the cross section of each passage in downstream direction urges the cooling fluid to leave the passage also in lateral direction by crossing the straight longitudinal edges of the delta wedge element, especially, when the top surface is underneath the outlet area. This amplifies the generation of paired delta-vortices and supports them in strength.

In an alternative or additional embodiment the top surface of the delta wedge element flushes at least partially with the second surface. With other words: the top surface is inclined compared to the diffusor bottom and/or the top surface is located at least partially in the outlet area.

Said inclination leads to an angle between the top surface of the delta wedge element and the cooling fluid main flow direction, so that the cooling fluid flow is amplified to stream over the longitudinal edges each formed by the top surface and the two side surfaces of the delta wedge element. Due to the inclination of the top surface relatively to the fluid flow direction the pressure is reduced in the wake zone of the wedge cooling fluid flow, and the cooling fluid flow is bended inwards onto the top surface once it has passed the delta wedge element longitudinal edges. From this initial movement the continued cooling fluid flow forms along each laterally edge a vortex, which spools onto the top surface. The so created vortices are called delta-vortices.

Further, the delta wedge element comprises only one single top surface, which is substantially flat. This embodiment is easy to manufacture.

Therefore the delta wedge element, also called wedge, is put onto the bottom of the diffusor with its leading edge facing towards inlet area of the film cooling hole. The cooling fluid emerging with high velocity from the metering section hits onto the leading edge of the delta wedge element and is directed into the delta-vortex by the mechanism described above. This pair of delta-vortices has the desired opposite swirl compared to the chimney vortices.

Most film cooling diffusors are manufactured into walls of a turbine airfoil surfaces or the like by laser technologies, which would be an ideal technique to leave the wedge as a leftover remaining in the diffusor. Since the volume of the diffusor to be taken out by the laser is significantly reduced by the wedge, this new diffusor type also helps to reduce manufacturing-time and -cost.

Additionally, using this manufacturing technology the diffusor is completely designable to best meet the targeted film cooling enhancement. Parameters like wedge-angle, wedge-length, or the heights of its leading edge or the width of its trailing end, the wedge position in the diffusor section or its top surface inclination, its leading edge angle or the distance between top surface and outer wall can be freely chosen within the given limits. The geometry seems only limited by laser accessibility, as long as its ability for delta-vortex-generation remains.

The easiest shape of a delta wedge element would be where the top surface is the remainder of the part surface. The top surface merges in this case with the second surface without any step or edge.

This simple geometry has also an additional advantage as the wedge pushes the cooling fluid laterally in direction to the diffusor side walls. In not-wedged diffusors this effect is left to pure aerodynamical diffusion, which limits the lateral opening angle of the diffusor and such the width of the film cooling fluid streak emerging from the diffusor. The higher the wedge element is, the stronger the fluid is supported to spread laterally.

The laterally displacing effect helps to widen the lateral opening angle of the diffusor without flow separation in the diffusor. By that, the lateral opening angle is not anymore limited by diffusor flow separation and significantly larger lateral opening angles become possible. Thereby, the film coverage of the hot gas part surface is increased, which increases film effectiveness additionally to the effect of the delta-vortex. This can enable the part to operate their turbines at increased hot gas temperatures. Vice versa, with wider diffusors less film cooling holes and less cooling fluid are needed to cover the wall surface with a gapless cooling film. Hence, the inventive film cooling hole could help to reduce cooling fluid consumption. This all helps to increase turbine efficiency and power output, when the wall is used in turbine parts.

Preferably, the delta wedge element is located inside the diffusor and therefore protected against pollution and hot gas erosion. It will stay in shape and such stay effective as vortex generator.

Beside this, the delta vortex is generated at the exit of the film cooling hole, no drag in the metering section of the film cooling hole reduces its swirl like it does in alternative methods, which create the kidney vortices at the film cooling hole inlet.

Additionally, the delta wedge element top surface can be easily covered with TBC. As a standard process, most hot gas parts like airfoils are first covered with bondcoat and TBC, and then the film cooling holes are lasered in. This process would leave a TBC layer on the delta wedge element top surface, increasing height and width of the wedge and thereby maximizing its vortex generation and lateral cooling fluid displacement with its benefits on cooling effectiveness described above.

The hot gas part comprising said wall comprising at least one, in particular a plurality of the film cooling holes described above, arranged in one or multiple rows of said film cooling holes. The hot gas part could be designed as a turbine blade of a rotor, a stationary turbine vane, a stationary turbine nozzle or a ring segment of gas turbine or as a combustor shell or the like. Other parts of a gas turbine could also comprise the inventive film cooling hole as long as a film cooling of the part is required.

BRIEF DESCRIPTION OF THE DRAWINGS

Embodiments of the invention are now described, by way of example only, with reference to the accompanying drawings, of which.

DETAILED DESCRIPTION OF INVENTION

Figure 1:
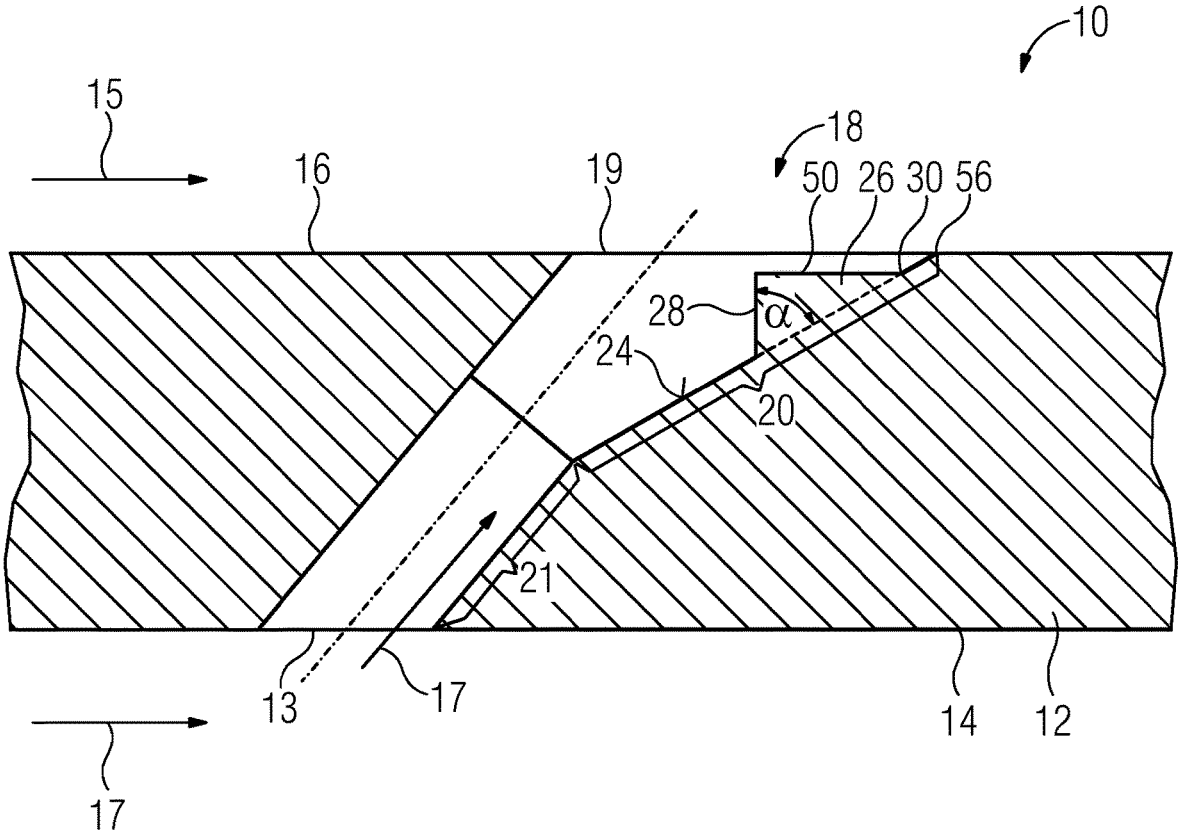
FIG. 1 shows a cross section through a wall comprising a film cooling hole according to the invention as a first exemplary embodiment.

The illustration in the drawings is in schematic form. It is noted that in different figures, similar or identical elements may be provided with the same reference signs. Further, features displayed in single figures could be combined easily with embodiments shown in other figures.

Figure 2:
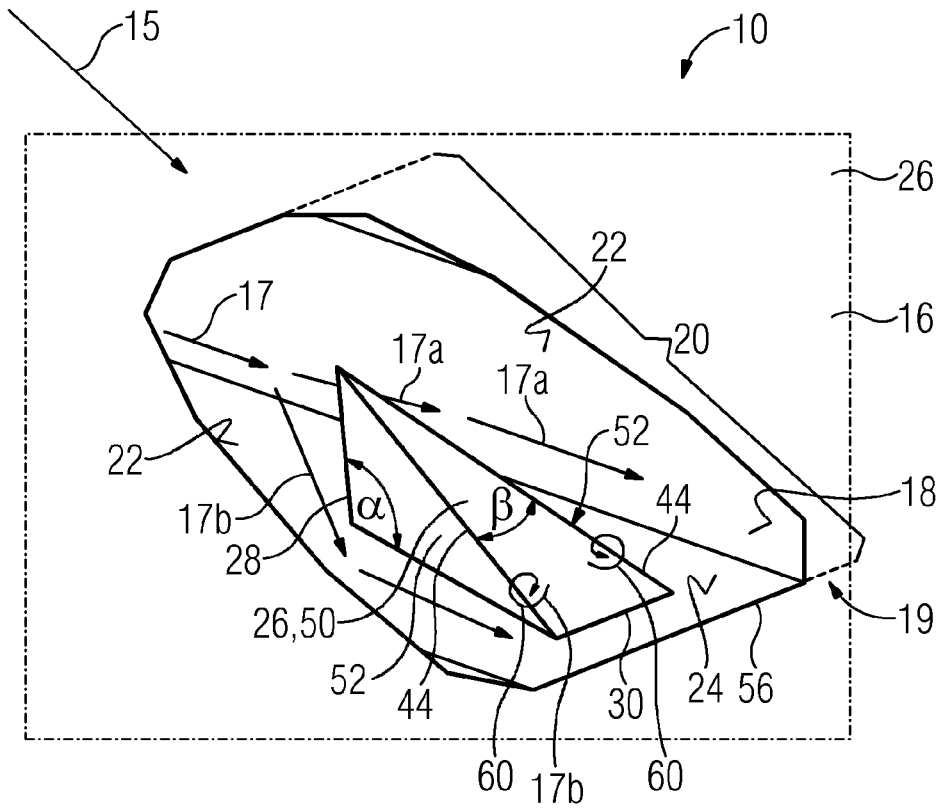
FIG. 2 shows a in a perspective view the film cooling hole according to FIG. 1.

FIG. 1 shows a cross section through a wall 12 of a hot gas part 10 designated to be assembled and used in a gas turbine (not shown). The wall 12 comprises a first surface 14 subjectable to a cooling fluid 17. Opposing to the first surface 14 the wall 12 comprises a second surface 16. The second surface 16 is dedicated to be subjectable to a hot gas 15. In the wall 12 multiple film cooling holes 18 (FIGS. 5-7) are located, from which only one is shown in FIG. 1. Each comprises an inlet area 13 located in the first surface 14. Further the film cooling hole 18 comprises an outlet area 19 located in the second surface 16. Further, the film cooling hole 18 comprises a diffusor section 20 located upstream of the outlet area 19 with regard to the direction of cooling fluid flow though the film cooling hole 18. Upstream of the diffusor section 20 the film cooling hole 18 comprises a metering section 21, which in cross sectional view has a circular shape. Other shapes than circular like elliptical are also possible. The diffusor section 20 is bordered at least by a diffusor bottom 24 and, adjacent thereto, by two opposing diffusor side walls 22 (FIG. 2). Diffusor bottom 24 is that part of the internal surface of the film cooling hole 18 that is opposite arranged to the first surface 14. The diffusor bottom merges laterally into each diffusor side walls 22 via rounded edges.

Figure 4:
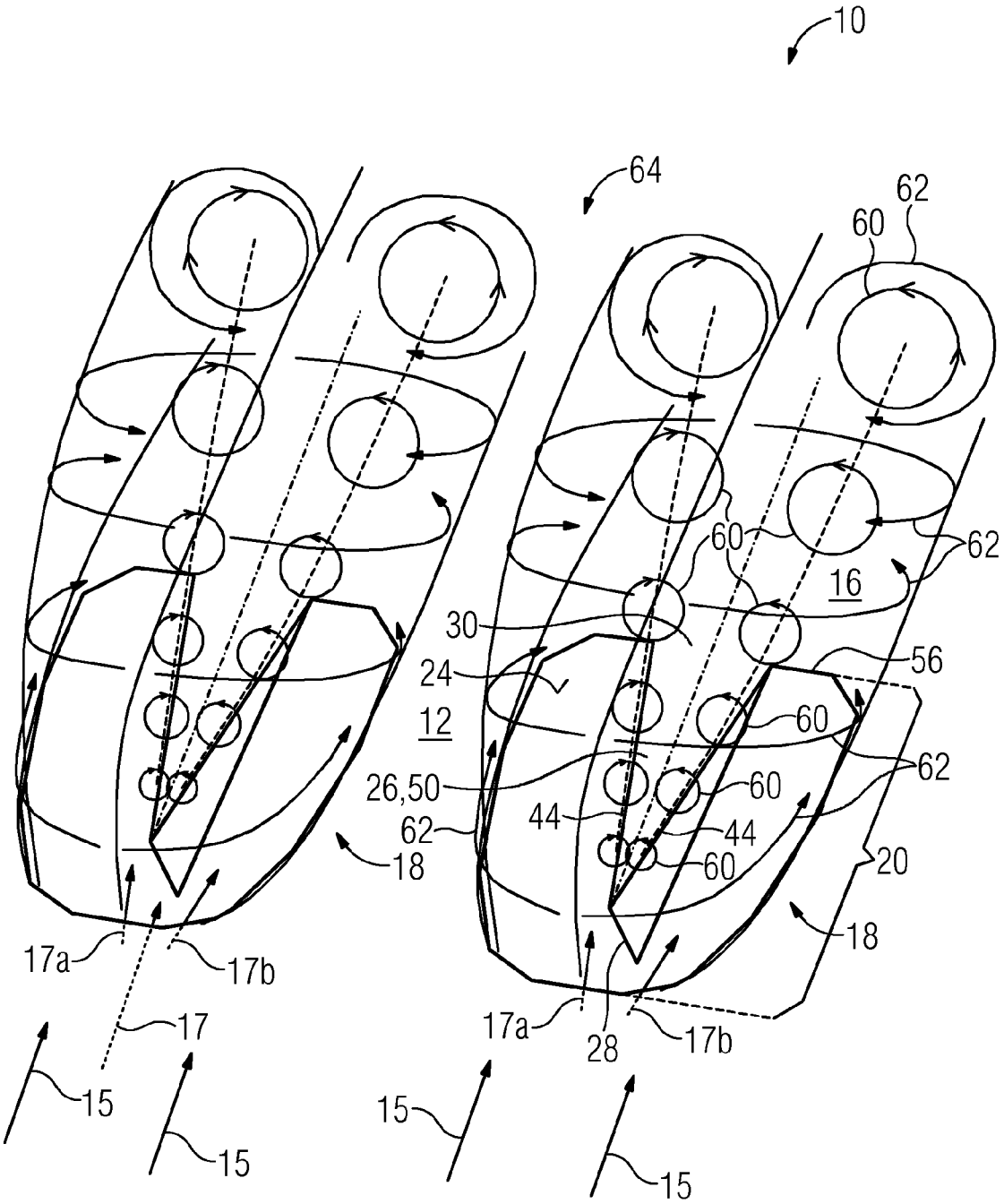
FIG. 4 shows two film cooling holes of a row in a perspective view according to a second exemplary embodiment and FIGS. 5 to 7 shows in a side view a turbine blade, a turbine vane and a ring segment each representing a wall comprising one or more rows of inventive film cooling holes.

According to the invention in the film cooling hole 18 onto the diffusor bottom 24 a delta wedge element 26 for dividing the cooling fluid flow into at least two subflows 17*a*, 17*b* is located. The delta wedge element 26 acts as means for generating delta-vortices 60 (FIG. 4).

According to the first exemplary embodiment as displayed in the FIGS. 1 and 2, the delta wedge element 26 comprises a leading edge 28 protruding in a stepwise manner from the diffusor bottom 24 as a means for generating delta-vortices 60. The leading edge 28 is straight and orthogonally arranged to the plane of the outlet area 19. In accordance with the cross section displayed in FIG. 1 the leading edge 28 and the diffusor bottom 24 incorporates an angle $\alpha$. Depending on the manufacturability, in a further embodiment the angle $\alpha$ is 90° or close to that value, as displayed in FIG. 3. Smaller or larger angle values are possible, as long as the leading edge supports the production of delta-vortices 60. In general the delta wedge element comprises only three surfaces, one flat top surface 50 and two side surfaces 52.

As displayed in FIG. 1, the diffusor bottom 24 is embodied as a plane. However, a slight convex or concave curvature is also possible.

As shown in FIG. 2, the delta wedge element 26 is wedged shaped extending from said leading edge 28 in direction of cooling fluid flow to a trailing end 30 in a triangular shaped manner. As a result, the delta wedge element 26 comprises two longitudinal edges 44 extending from said leading edge 28 to said trailing end 30 and incorporating a wedge-angle $\beta$ there between. In a further embodiment the wedge-angle $\beta$ has a value not smaller than 15°. However, if desired to optimize the beneficial effects of the delta-vortex, also larger or smaller wedge-angles $\beta$ are possible. Further, the wedge-angle $\beta$ is selected such that the longitudinal edges 44 and their just two side surfaces 52 of the delta wedge element 26 are parallel to the diffusor side wall 22 to simplify manufacturing. However, when the wedge-angle $\beta$ is larger than a lateral opening angle of the diffusor, the strength of the delta-vortices spooling on a top surface 50 can be increased. The lateral opening angle of the diffusor is determined in a top view between the two side walls 22 of the diffusor section 20.

The delta wedge element top surface 50 can be located, as displayed in FIG. 1, underneath the outlet area 19 completely. However, the top surface 50 could also be angled with regard to the outlet area 19. According to FIG. 1, if the top surface 50 is flat and located underneath the outlet area 19 the trailing end 30 is about a distance to a trailing edge 56 of the diffusor section 20.

If the ideal delta wedge element geometry should feature a height of the top surfaces 50 less than the plane of the second surface 16 as displayed in FIG. 2, the laser can take out any amount of material above the delta wedge element to form any desired top surface shape. In that case, the wedge would be completely uncovered as the rest of the diffusor surface is.

Figure 3:
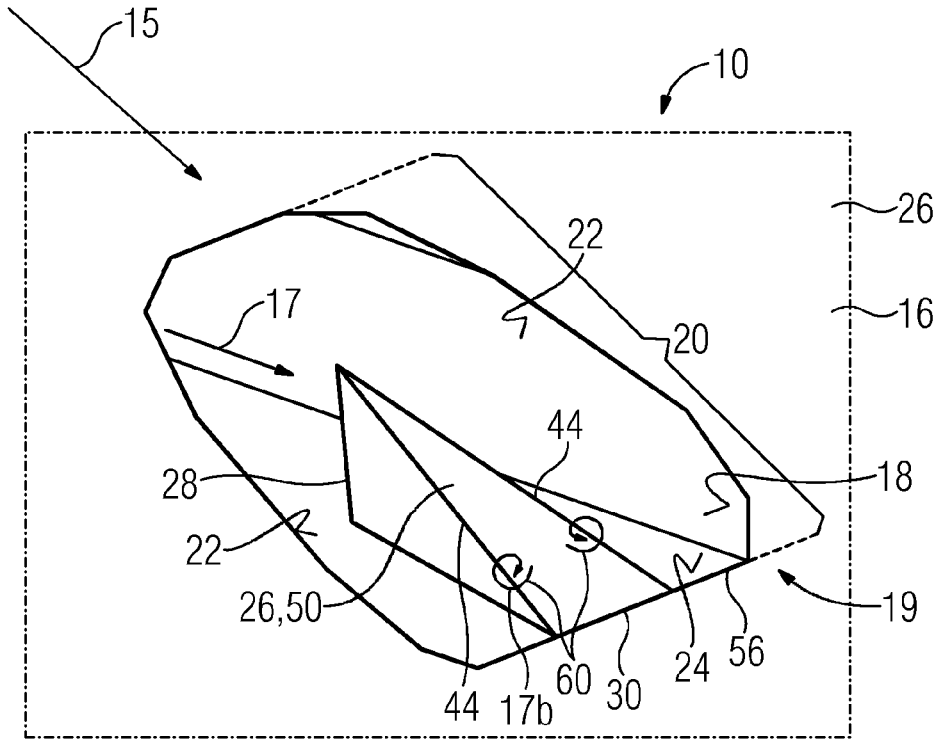
FIG. 3 shows in a perspective view the film cooling hole according to a second exemplary embodiment.

FIG. 3 shows also in a perspective view a film cooling hole 18 according to a second exemplary embodiment. Since the main features of the second exemplary embodiment are identical to the features of the first exemplary embodiment, only the differences between the first and second exemplary embodiments are explained here. According to the second exemplary embodiment the trailing end 30 of the delta wedge element 26 merges with the trailing edge 56 of the diffusor section 20, such, that the end of the top surface 50 of the delta wedge element merges with the second surface 16. Depending on the height of the leading edge 28, the top surface 50 merges with or without an edge into the second surface 16 while flushing with the second surface 16.

The effect of the invention will be described in accordance with FIG. 4. FIG. 4 shows a row of film cooling holes 18 comprising a large number of film cooling holes 18, from which only two are displayed in FIG. 4. Each of the displayed film cooling holes 18 comprises the same features according to the second exemplary embodiment. During operation of a gas turbine a hot gas part that comprises the wall 12 having said film cooling holes 18, the hot gas 15 flows along the second surface 16 of said wall 12. The hot gas 15 flows over the outlet area 19 of the film cooling hole 18 and around the jet of cooling fluid emerging from film cooling hole 18 while generating the afore mentioned chimney vortices 62. The chimney vortices 62 are generated pair-wise with first swirl-directions.

The cooling fluid 17 provided to the first surface 14 of the wall 12 enters the inlet area 13 of the film cooling hole 18 and flows first through the metering section 21. After entering the diffusor section 20 the cooling fluid hits the leading edge 28 of the delta wedge element 26 and is separated into o two subflows. Each of the subflows travels along the passage arranged between the side surfaces 52 of the delta wedge element and the diffusor side walls. Parts of each sub flows flow over the longitudinal edges and generates delta-vortices 60 with a second swirl direction. These delta-vortices spool along the longitudinal edges onto the top surface 50. Due to the flow dividing effect of the delta wedge element 26, the delta-vortices are generated pair-wise.

As displayed in FIG. 4 the delta-vortices 60 with the second swirl direction has an opposite swirl direction compared to the first swirl direction of the chimney-vortices 62. These opposing directions compensate the harmful hot gas entrainment-effect between the chimney-vortices 62 of two neighbored film cooling holes. As a result, the lateral film cooling effectively downstream of the film cooling hole 18 is increased while the wall temperature is reduced, compared to the prior art. The improved cooling effectiveness could be used either or in combination to reduce the number of film cooling holes within a row or to reduce the amount of cooling fluid, which has to spend. In summary, said savings leads to an increase of efficiency of a gas turbine using said inventive film cooling holes in their hot gas parts, as described before.

Figure 5:
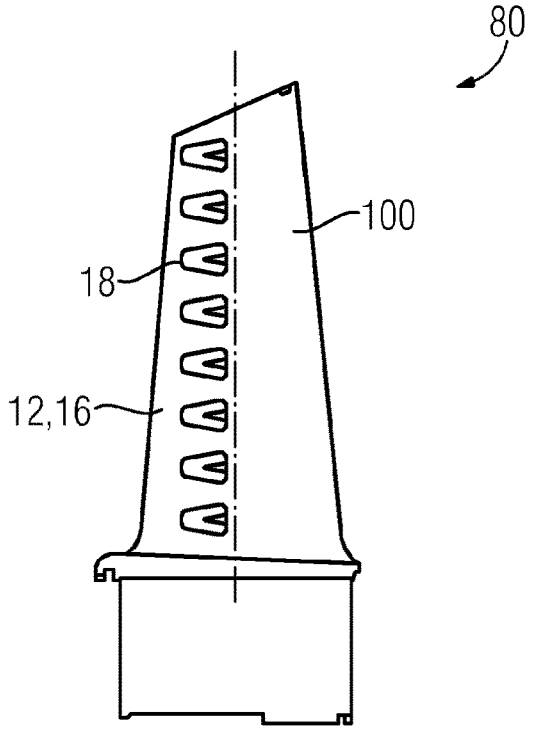
Figure 6:
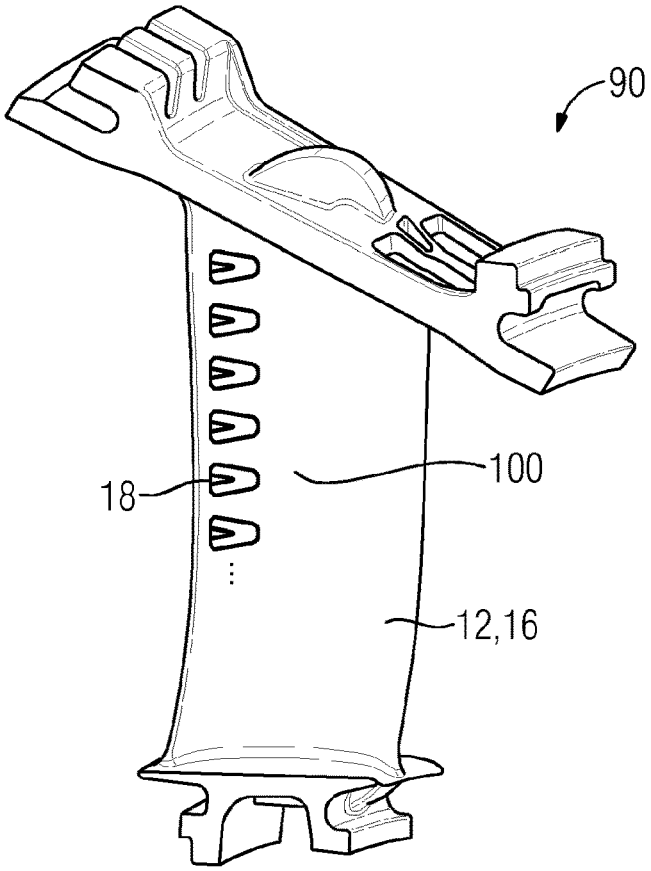

FIGS. 5 and 6 show in a side view a turbine blade 80 and a turbine vane 90 of a gas turbine. Each turbine blade 80 and turbine vane 90 could comprise fastening elements for attaching said part to a carrier, either a rotor disk or a turbine vane carrier. They further comprise a platform and an aerodynamically shaped airfoil 100, which comprise one or more rows of film cooling holes 18, from which only one row is displayed. Either each of the film cooling holes 18 or single ones can be embodied according to the first or second or similar exemplary embodiments.

Figure 7:
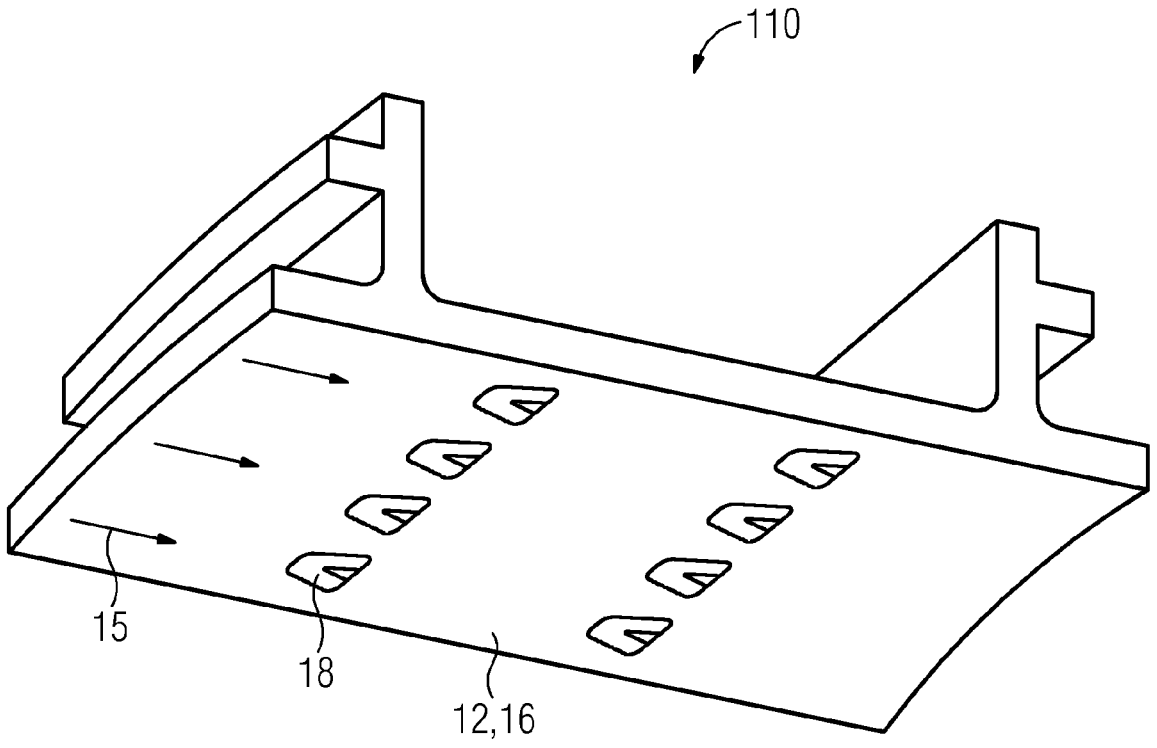

FIG. 7 shows in a perspective view a ring segment 110 comprising two rows of inventive film cooling holes 18. The displayed ring segment could also be used as a combustor shell element.

Although the present invention has been described in detail with reference to the described embodiment, it is to be understood that the present invention is not limited by the disclosed examples, and that numerous additional modifications and variations could be made thereto by a person skilled in the art without departing from the scope of the invention.

It should be noted that the use of "a" or "an" throughout this application does not exclude a plurality, and "comprising" does not exclude other steps or elements. Also elements described in association with different embodiments may be combined. It should also be noted that reference signs in the claims should not be construed as limiting the scope of the claims.

The invention claimed is:

1. A wall of a hot gas part, comprising:

a first surface subjectable to a cooling fluid, a second surface located opposite of the first surface and subjectable to a hot gas and, at least one film cooling hole extending from an inlet area located within the first surface to an outlet area located within the second surface for leading the cooling fluid from the first surface to the second surface, wherein the at least one film cooling hole comprises a diffusor section located upstream of the outlet area with regard to a direction of the cooling fluid flow through the film cooling hole, wherein the diffusor section is bordered at least by a diffusor bottom and two opposing diffusor side walls, wherein the diffusor section comprises a delta wedge element for dividing the cooling fluid flow into two subflows, wherein the delta wedge element extends from a leading edge to a trailing end with regard to direction of the cooling fluid flow, wherein the delta wedge element comprises a top surface and two side surfaces and protrudes in a stepwise manner from the diffusor bottom and is, in a top view, triangular-shape, wherein the top surface of the delta wedge element is lower than the second surface, and whereon the leading edge of the delta wedge element is orthogonally arranged to a plane of the outlet area.

2. The wall according to claim 1, wherein the delta wedge element is adapted to create a pair of delta vortices in the cooling fluid flow during operation.

3. The wall according to claim 1, wherein, when seen in cross section through the film cooling hole, the leading edge protrudes with an angle $\alpha$ of at least 35° from a plane of the diffusor bottom.

4. The wall according to claim 1, wherein the delta wedge element comprises two longitudinal edges, each extending from the leading edge to the trailing end, both two longitudinal edges incorporating a wedge-angle $\beta$ there between, wherein the wedge-angle $\beta$ has a value of at least 15°.

5. The wall according to claim 1, wherein the top surface is inclined compared to the diffusor bottom.

6. The wall according to claim 1, wherein the delta wedge element comprises only one single top surface, which is flat.

7. The wall according to claim 1, wherein the diffusor bottom comprises a downstream edge, at which the diffusor section and the second surface merge together in a stepless manner or with an edge, the trailing end of the delta wedge element being located at the downstream edge of the diffusor bottom or upstream thereof.

8. The wall according to claim 1, further comprising:

a plurality of said film cooling holes, arranged in one or more rows of film cooling holes.

9. Hot gas part for a gas turbine, comprising:

a wall according to claim 1.

* * * * *